US005292197A

United States Patent [19]

Reisman

[11] Patent Number: 5,292,197

[45] Date of Patent: Mar. 8, 1994

[54] SELF-EXPANDING FILLER

[76] Inventor: Ron Reisman, 5 Hasatat, Jerusalem, Israel

[21] Appl. No.: 35,834

[22] Filed: Mar. 23, 1993

[51] Int. Cl.[5] ..... A45C 7/00

[52] U.S. Cl. ..... 383/127; 383/33

[58] Field of Search ..... 383/127, 33; 229/120.24, 120.25, 120.26, 120.29, 120.33, 120.36

[56] References Cited

U.S. PATENT DOCUMENTS

| | | | |
|---|---|---|---|
| 3,343,742 | 9/1967 | Siegler | 229/120.36 |
| 3,767,106 | 10/1973 | Morgan | 229/120.36 |
| 4,946,292 | 8/1990 | Diamond et al. | 383/127 |
| 4,969,751 | 11/1990 | Diamond et al. | 383/127 |
| 4,993,846 | 2/1991 | Diamond et al. | 383/127 |
| 5,030,014 | 7/1991 | Diamond et al. | 383/127 |
| 5,179,600 | 1/1993 | Bailey et al. | 383/127 |

*Primary Examiner*—Allan N. Shoap

*Assistant Examiner*—Jes F. Pascua

*Attorney, Agent, or Firm*—Mark M. Friedman

[57] ABSTRACT

A self-expanding filler, preferably of cardboard, for use in stuffing soft items, such purses and backpacks for display purposes at the retail outlet after being shipped flat with the item, which includes two structural members, each of which includes several panels, adjacent panels being pivotally connected to each other about their common boundary. Each of the panels includes a slot set off from the common boundary and extending parallel to the common boundary from a point on the edge of the panel, so that corresponding panels of the two structural members can interlock. The filler further includes an elastic cord, such as a rubber band which is connected to interlocking panels of the two structural members which acts to urge the interlocking panels to orient themselves substantially perpendicular to each other when they not constrained to lie flat against each other, as during shipping.

12 Claims, 3 Drawing Sheets

SELF-EXPANDING FILLER

FIELD AND BACKGROUND OF THE INVENTION

The present invention relates to fillers such as might be used to stuff soft purses, backpacks, and similar items, especially for purposes of displaying such items for sale.

It is often desirable to display soft purses, soft suitcases, backpacks, and similar items, at the point of sale to the ultimate consumer with the item filled, or stuffed, with paper, tissue, or similar materials. The stuffed item thus appears to the consumer approximately as it would when the item is in actual use, makes the item more attractive and generally facilitates the consumer's decision to purchase the item.

Some manufacturers of certain such items normally stuff the items at the factory and ship the stuffed items to the wholesalers who, in turn, transport the items to the retail outlets.

However, in many cases, especially when the cost of transportation is a significant fraction of the total cost of the item, it is typically easiest and cheapest to ship the item to the retail outlet while the item is flat. In this way the shipping costs, which are typically strongly tied to the volume of the shipment, are significantly reduced and the chances of damaging the item in transit are greatly reduced. The disadvantage of shipping an item flat is that once the flat item arrives at the retail outlet, the retailer must spend precious time stuffing the item, usually with suitable paper, which must be provided by the retailer. The task is generally an unappealing one and the stuffed item is not always filled in such a way that the item is displayed to best advantage.

There is thus a widely recognized need for, and it would be highly advantageous to have, a filler device for items which need to be stuffed, which would be inexpensive, would be mostly an empty structure so as to reduce the materials required, would have the ability of lying flat so that it could readily be shipped along with, or in, a flat item, and would be very easily and automatically deployed, requiring very little effort on the part of the retailer to stuff the item to the proper dimensions.

SUMMARY OF THE INVENTION

According to the present invention there is provided a self-expanding filler device for use in stuffing a soft item, comprising: (a) a first structural member including at least two panels, adjacent panels being pivotally connected to each other about their common boundary, each of the panels including a slot set off from the common boundary and extending substantially parallel to the common boundary from a point on the edge of the panel; (b) a second structural member including at least two panels, adjacent panels being pivotally connected to each other about their common boundary, each of the panels including a slot set off from the common boundary and extending substantially parallel to the common boundary from a point on the edge of the panel for interlocking with the panels of the first structural member; and (c) self-expanding means connected to interlocking panels of the first and second structural members to urge the interlocking panels to orient substantially perpendicular to each other.

According to further features in preferred embodiments of the invention described below, the self-expanding means includes an elastic element, preferably a rubber band, connecting interlocking panels, preferably corresponding boundaries, of the first and second structural members.

According to still further features of the described preferred embodiments the device includes restraining means for counteracting the effect of the self-expanding means so as to keep the device substantially flat until it is desired to deploy the device, at which point the restraining means can be removed or otherwise disabled. These restraining means may include a clip, an adhesive or an elastic band joining opposing corners.

The present invention successfully addresses the shortcomings of the presently known configurations by providing a filler device which is essentially flat so that it can be shipped along with, preferably inside, the item to be filled. Upon reaching the destination where the item is to be displayed, the user allows the device to self-expand to its proper size and shape, which size and shape can be designed to best display the stuffed item.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a filler device which can be shipped flat, preferably with, most preferably, inside, the item to be stuffed and which can quickly and easily be allowed to self-expand to its full size just when it is desired to stuff the item, for example, in order to put the item on display in a retail outlet.

The principles and operation of a filler device according to the present invention may be better understood with reference to the drawings and the accompanying description.

Figure 1:
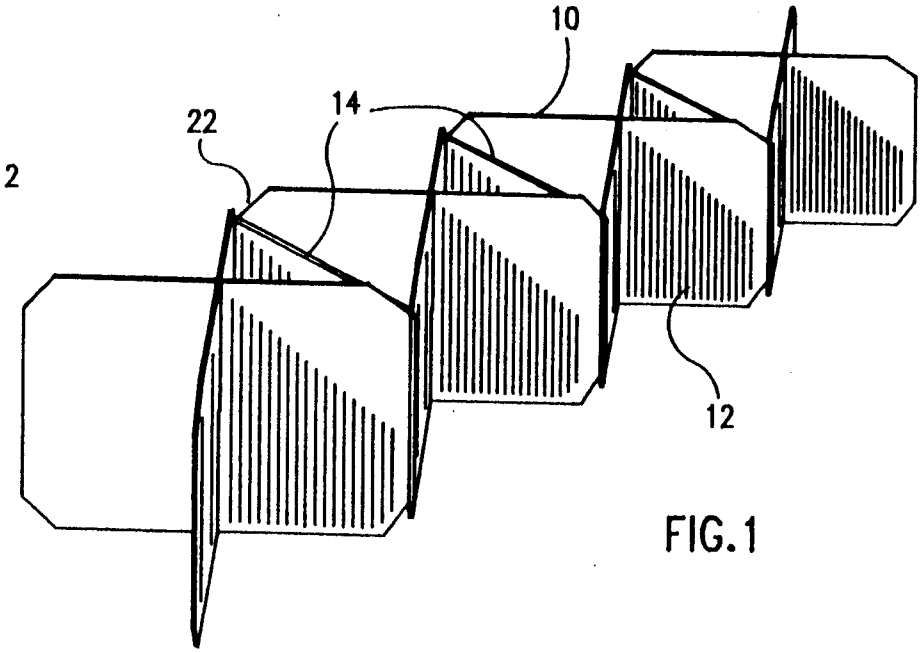
FIG. 1 is a perspective view of a filler device according to the present invention when fully expanded.

Referring now to the drawings, FIG. 1 illustrates a device according to the present invention in its expanded condition. The device is preferably made up of three elements—a first structural member 10, a second structural member 12, which is preferably identical to first structural member 10, and one or more elastic members 14.

Each of structural members, 10 and 12, is made up of at least two panels. The overall shape of each of structural members, 10 and 12, is rectangular which allows the members to be cut from a large sheet of material with virtually no wastage. Adjacent panels are pivotally connected to each other about their common boundary 16. Preferably, each of structural members, 10 and 12, is made of a single piece of material, such as plastic or, preferably, paper or cardboard, with common boundary 16 created by scoring, or by other techniques, which allows adjacent panels to pivot, within limits, about common boundary 16.

Figure 2:
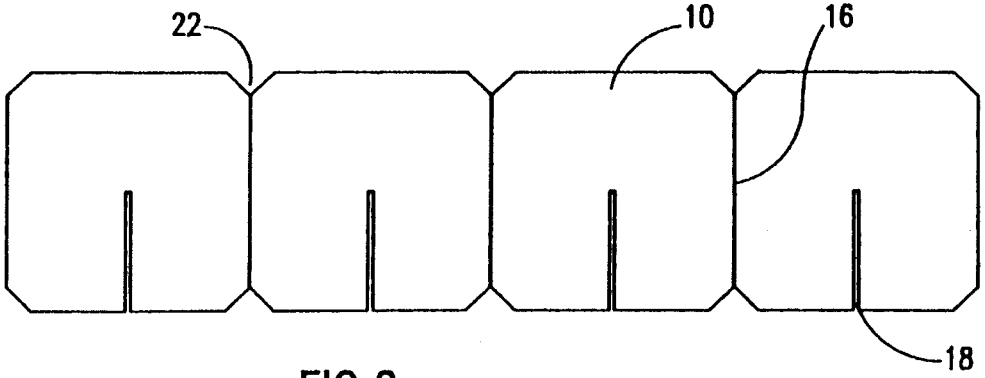
FIG. 2 is a plan view of one of the two structural members.

Panels of each structural member, 10 and 12, preferably each such panel, includes a slot 18 which is set off from common boundary 16, preferably located half-way between two adjacent common boundaries 16, which extends substantially parallel to common boundaries 16 from a point on the edge of the panel to a point between the two edges of the panel, preferably to a point which is half-way between the two edges of the panel, as can best be seen in FIG. 2.

Structural members, 10 and 12, and their slots 18 are sized and shaped so that structural members, 10 and 12, can be made to loosely interlock with each other by sliding corresponding slots 18 of structural members, 10 and 12, through each other (FIG. 1) to form interlocking pairs of panels, each member of such pair belonging to one of structural members, 10 or 12.

Slots 18 are dimensioned so as to readily allow the interlocking of structural members, 10 and 12, and to allow interlocking panels to rotate relative to each other about the axis of slots 18 to a degree sufficient to permit interlocking panels to lie virtually flat against each other.

Figure 3:
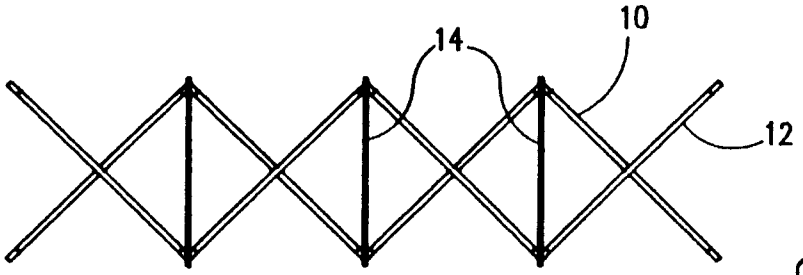
FIG. 3 is a side view of the device of FIG. 1 when fully expanded.

Shown in FIG. 3 is a device according to the present invention when in its fully extended condition. It is to be noted that in its extended position, a device according to the present invention includes relatively thin and light structural elements which define a very large volume, which is, for most part, empty. Thus, a great savings in material is obtained, compared, for example, with the commonly used alternative of using paper or tissue to stuff the item. It is to be further noted that a typical device according to the present invention, because of its expandability, can be usefully employed with items of a certain size range, which is not the case where a rigid structure which is specially sized and shaped is used.

Figure 4:
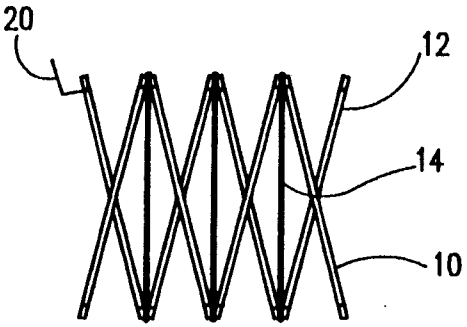
FIG. 4 is a side view of the device of FIG. 3 when partly compressed so as to partially flatten the device.

Through the application of appropriate force it is possible to compress the device to the extent shown in FIG. 4 and beyond, so that interlocking panels lie approximately parallel to, and touching, each other (not shown).

In such a condition, the device is virtually flat, takes up very little space and can be easily and inexpensively shipped along with, preferably inside, the item, such as soft purse or backpack, which is to be stuffed for display at the point of sale.

A device according to the present invention further includes suitable means for automatically expanding to its desired dimensions. Any suitable means may be used, including, but not limited to, various springs and elastic elements. Preferably, the expansion is achieved through use of an elastic element, most preferably a rubber band 14, which connects appropriate portions of interlocking panels, preferably the two common boundaries between opposing pairs of panels of structural members, 10 and 12. Preferably, a plurality of rubber bands 14 is used, most preferably, one rubber band 14 is used for each pair of corresponding common boundaries. Most preferably, each rubber band 14 forms a complete loop and is retained in place by engaging slits 22 which are preferably included at both ends of common boundaries 16 of each structural member, 10 and 12.

The length of the elastic element, or rubber band 14, is such that it exerts no forces on structural elements, 10 and 12, when the device is in its fully extended condition (FIGS. 1 and 3). However, when structural members, 10 and 12, are pressed so as to bring interlocking panels close together (for example as in FIG. 4), rubber bands 14 are stretched and exert a force tending to rotate interlocking panels of structural members, 10 and 12, about their slots 18 so as to restore the device to its fully expanded condition, wherein interlocking panels of structural members, 10 and 12, are approximately perpendicular to each other (FIGS. 1 and 3).

Prior to shipping an item, such as a soft purse or backpack, the manufacturer compresses a properly shaped and sized device against the force of the elastic members, until the device is fairly flat, with interlocking panels lying essentially flat against each other. In this condition, the rubber bands are stretched and strive to contract and expand the device to its fully extend shape. To prevent the premature expansion of the device, a suitable restraint is provided. Such a restraint can be achieved by placing the flattened device inside the item in such a way that it is blocked by the item itself from expanding. Preferably, the device includes a dedicated restraint 20 (FIG. 4), which may be a properly located piece of tape or other closure mechanism which can be activated once the device is in its flattened state and which can be removed or otherwise disabled when it is desired to allow the device to expand.

Figure 5:
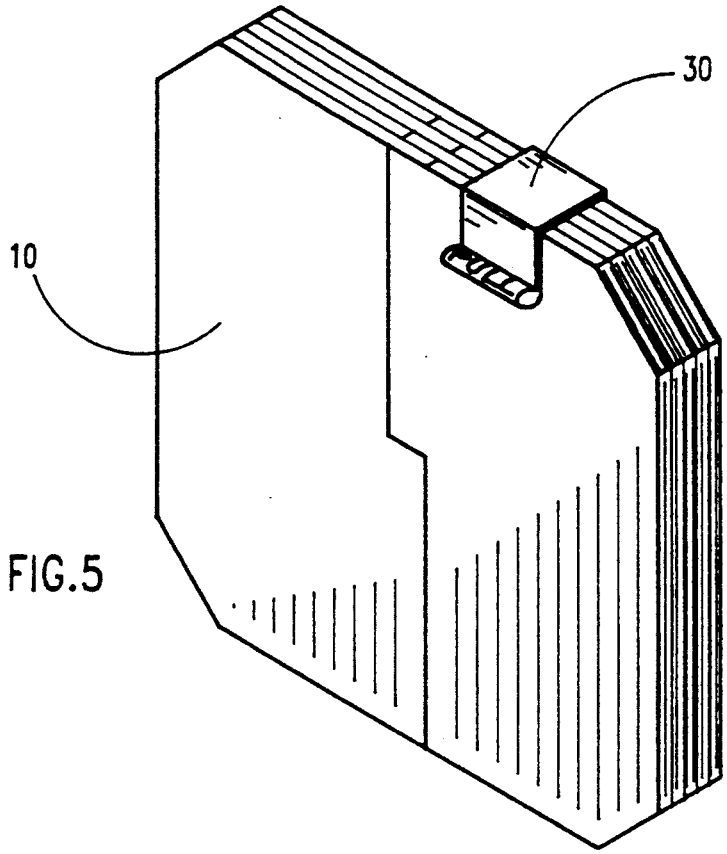
FIG. 5 is a perspective view of a fully flattened device with an adhesive tape as the restraining means.
Figure 6:
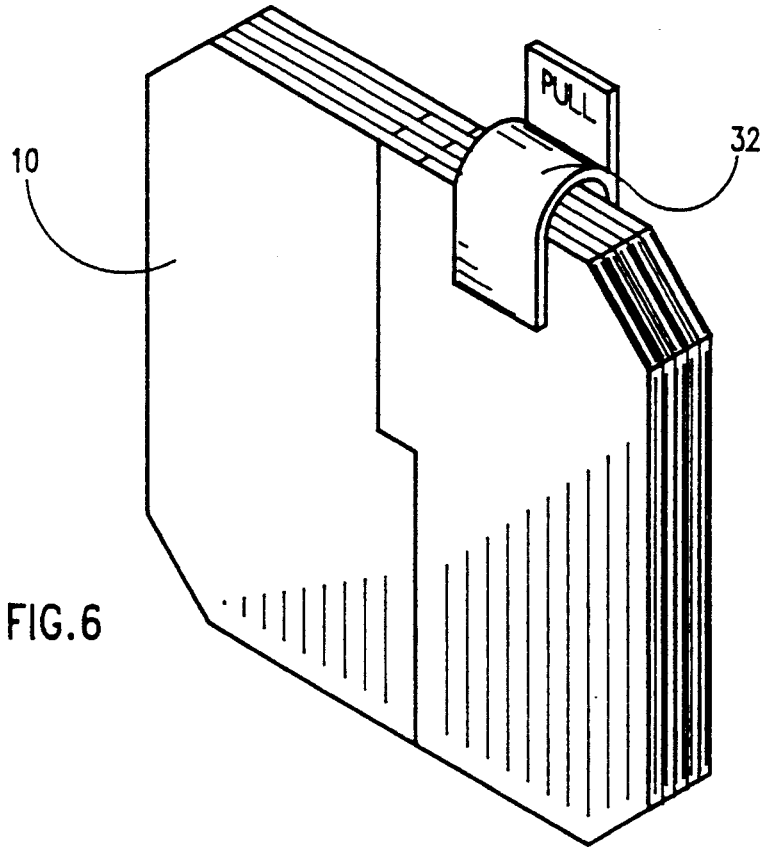
FIG. 6 is a perspective view of a fully flattened device with a clip as the restraining means.

Illustrative restraining means are shown in FIGS. 5–8. Shown in FIG. 5 is a restraint which is essentially a piece of adhesive tape 30, preferably featuring a pull-up tab for ease of deployment. In the embodiment of FIG. 6 the restraint is a clip 32 which can be readily removed.

Figure 8:
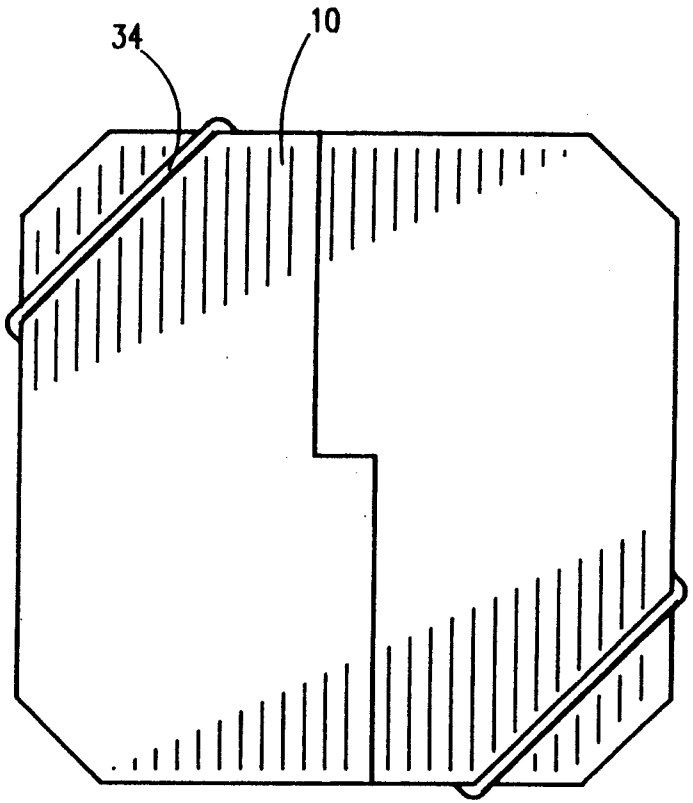
FIG. 8 is a plan view of the device of FIG. 7 but showing the other side of the device.
Figure 7:
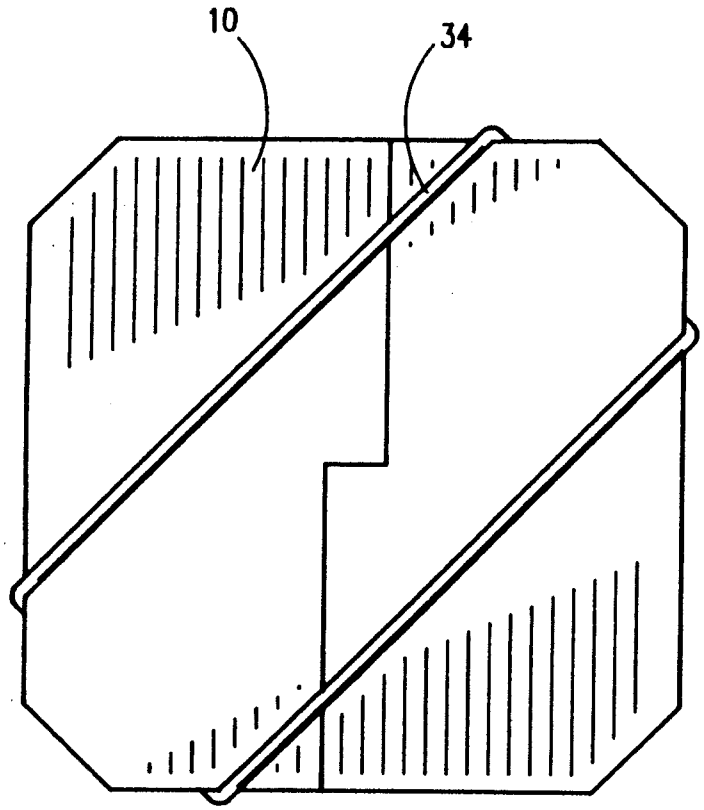
FIG. 7 is a plan view of a fully flattened device with an elastic band joining opposite corners as the restraining means.

Shown in FIGS. 7 and 8 are front an back views of another, and preferred, means for restraining. The restraint is an elastic band 34 of suitable length and elasticity. Elastic band 34 may be similar to, or even identical with, elastic members 14 (FIGS. 1, 3 and 4), which simplifies and facilitates the manufacture of the device. Elastic band 34 is installed by stretching over opposing corners of the flattened deice, as can be seen in FIGS. 7 and 8 and serves to retain the device in the flattened position until elastic band 34 is removed. Under certain circumstances it may be desirable to use a second elastic band (not shown) to join the remaining pair of opposite corners of the device.

Preferably, a flattened device according to the present invention, suitably restrained from expanding, is placed by the manufacturer inside each item which is later to be stuffed of filled. The device lies flat and does not significantly increase the size or weight of the shipped item. When the item arrives at the retail outlet and is ready for display, the restraint is removed or disabled and the elastic members serve to automatically expand the device to its full size, allowing it to serve as a suitable stuffing or filler for the item.

While the invention has been described with respect to a limited number of embodiments, it will be appreciated that many variations, modifications and other applications of the invention may be made.

What is claimed is:

1. A self-expanding filler device for use in stuffing a soft item, comprising:

(a) a first structural member including at least two adjacent panels being pivotally connected to each other about a common boundary, each of said panels including a slot set off from said common boundary and extending substantially parallel to said common boundary from a point on the edge of said panel;

(b) a second structural member including at least two adjacent panels being pivotally connected to each other about a common boundary, each of said panels including a slot set off from said common boundary and extending substantially parallel to said common boundary from a point on the edge of said panel each slot of said panels of said second structural member interlocking with said panels of said first structural member; and (c) self-expanding means connected to interlocking panels of said first and second structural members to urge said interlocking panels to orient substantially perpendicular to each other.

2. A device as in claim 1 wherein said self-expanding means includes an elastic element connecting interlocking panels of first and second structural members.

3. A device as in claim 1 wherein said self-expanding means includes an elastic element connecting corresponding boundaries of first and second structural members.

4. A device as in claim 2 wherein said elastic element is a rubber band.

5. A device as in claim 3 wherein said elastic element is a rubber band.

6. A device as in claim 1 further comprising restraining means for counteracting the effect of said self-expanding means and keep the device substantially flat, said restraining means being removed to allow said self-expanding means to expand the device.

7. A device as in claim 6 wherein said restraining means includes an adhesive tape.

8. A device as in claim 6 wherein said restraining means includes a clip.

9. A device as in claim 6 wherein said restraining means includes an elastic band joining opposite corners of the device.

10. A device as in claim 1 wherein said first and second structural members are made of paper.

11. A device as in claim 1 wherein said first and second structural members are made of cardboard.

12. A device as in claim 1 wherein said panels of each of first structural member and second structural member are integrally formed and said boundaries between adjacent panels are scored.

* * * * *